US005582039A

United States Patent [19]

Mueller et al.

[11] Patent Number: 5,582,039

[45] Date of Patent: Dec. 10, 1996

[54] INTEGRATED TUB RING WITH CLOTHES DIVERTER

[75] Inventors: Dale E. Mueller, Benton Harbor; Gerald L. Kretchman; R. Bruce Sherer, both of St. Joseph, all of Mich.

[73] Assignee: Whirlpool Corporation, Benton Harbor, Mich.

[21] Appl. No.: 429,611

[22] Filed: Apr. 27, 1995

[51] Int. Cl.[6] ..... D06F 37/00; D06F 39/02; D06F 39/08

[52] U.S. Cl. ..... 68/17 R; 68/23 R; 68/23.5; 68/196; 68/207

[58] Field of Search ..... 68/17 R, 23 R, 68/23.5, 196, 207

[56] References Cited

U.S. PATENT DOCUMENTS

| | | | |
|---|---|---|---|
| 2,619,825 | 12/1952 | Rosenkrans et al. | 68/23.5 |
| 2,703,974 | 3/1955 | Clark | 68/207 X |
| 3,027,741 | 4/1962 | Bullock et al. | 68/17 R |
| 3,033,427 | 5/1962 | Petersen | 68/207 X |
| 3,121,317 | 2/1964 | Toma | 68/23 R |
| 3,320,777 | 5/1967 | Morey | 68/17 R X |
| 3,526,105 | 9/1970 | Anthony | 68/23.5 X |
| 3,604,225 | 9/1971 | Douglas | 68/23.5 |
| 3,863,467 | 2/1975 | Pielemeier et al. | 68/18 F |
| 4,000,968 | 1/1977 | Schrage et al. | 68/23.5 X |
| 4,186,573 | 2/1980 | Brenner et al. | 68/17 R X |
| 4,700,554 | 10/1987 | Eichman et al. | 68/17 R |
| 5,092,141 | 3/1992 | Quinn | 68/17 R |

FOREIGN PATENT DOCUMENTS

| | | | |
|---|---|---|---|
| 1130402 | 5/1962 | Germany | 68/23 R |

*Primary Examiner*—Philip R. Coe
*Attorney, Agent, or Firm*—Hill, Steadman & Simpson

[57] ABSTRACT

A tub ring is provided which forms an opening to a rotatable wash basket of a washing machine. The tub ring includes a clothes diverter which guides and deflects clothes in the basket downward, away from the opening, so that the clothes are wetted quickly. Preferably, the diverter guides the clothes into a flow from an inlet nozzle, which can also be formed in the tub ring. Additionally, dispensers for wash additives can be formed in the tub ring.

18 Claims, 3 Drawing Sheets

INTEGRATED TUB RING WITH CLOTHES DIVERTER

BACKGROUND OF THE INVENTION

The present invention is generally directed to an automatic clothes washing machine (hereinafter "washer"). More particularly, the present invention is directed to a ring surrounding the opening of a wash tub of a washer.

Tub rings for washers are generally known. Known tub rings are usually formed of plastic or metal. Basically, a tub ring defines an opening in a top loading washer into the tub through which clothes are placed and removed. Desirably, the tub ring has a smaller inner diameter than the wash basket, forming an overhanging lip to prevent items from being dropped into the machine between the wash basket and the tub.

Certain desirable washer features have been incorporated into tub rings. Specifically, it is known to provide a tub ring having an integrated detergent or additive dispenser. For example, U.S. Pat. Nos. 5,092,141 and 4,700,554 relate to such a tub ring having an additive dispenser. Also, tub rings are known which include a nozzle for directing water into the tub. For example, U.S. Pat. No. 4,186,573 relates to a tub ring having an integrally formed water inlet nozzle.

Efficiency and short wash times are desirable in washers. Clothes are initially placed in the wash basket in a dry condition. Dry clothes are somewhat "fluffed up", occupying a large volume of the wash basket. During an initial startup period in a wash cycle, the dry clothes are wetted by the spray nozzle until the desired water level is reached. Wet clothes tend to collapse and sink in the basket, occupying less basket volume. In a conventional washer, this initial wetting of the dry clothes can take a substantial amount of time. Only after clothes are wetted with water can effective washing take place. Therefore, clothes are desirably wetted as quickly as possible in order to reduce the necessary overall wash time.

SUMMARY OF THE INVENTION

A tub ring is provided having a clothes diverter. The diverter is generally a downwardly slanted or curved ramp which serves to downwardly deflect dry clothes disposed at an upper portion of a wash basket during an initial startup of the wash cycle. This deflection forces the dry clothes under a spray nozzle. As the dry clothes are wetted, they sink into the basket and occupy less volume and effective washing can ensue. The diverter speeds the wetting of clothes in the basket, thereby decreasing the overall required wash time. The tub ring can be formed of molded plastic, having integrated components such as one or more additive dispensers and/or one or more spray nozzles.

In an embodiment, a diverter is provided for a clothes washer wherein the washer has a housing and a rotatable wash basket with an upper opening. The diverter is securable to the housing, and includes a projection extending downwardly in the basket, deflecting clothes in the basket away from the opening when the basket rotates.

In an embodiment, the washer includes a nozzle adjacent to the opening providing a flow of water into the basket. The diverter extends downwardly adjacently to the nozzle so that the clothes are deflected downwardly into the flow.

In an embodiment, the diverter is curved in shape.

In an embodiment, the diverter is a sloped or ramp-like wall.

In an embodiment, the diverter is integral to a tub ring.

In an embodiment, the tub ring defines an upper opening to the rotatable wash basket. The tub ring is dimensioned to have an inner diameter smaller than a diameter of the basket, forming an overhang. The diverter extends downwardly from the overhang.

In a related embodiment, the tub ring includes an additive dispenser.

In another related embodiment, the tub ring also includes the spray nozzle.

It is, therefore, an advantage of the present invention to provide a diverter for a washer which causes dry clothes to become quickly wetted during a wash cycle.

Another advantage of the present invention is to provide a washer which operates with a reduced wash time.

A further advantage of the present invention is to provide a molded tub ring for a washer defining an opening to the wash basket, wherein the tub ring can include various desired features.

Additional features and advantages of the present invention are described in, and will be apparent from, the detailed description of the presently preferred embodiments.

DETAILED DESCRIPTION OF THE PRESENTLY PREFERRED EMBODIMENTS

Figure 1:
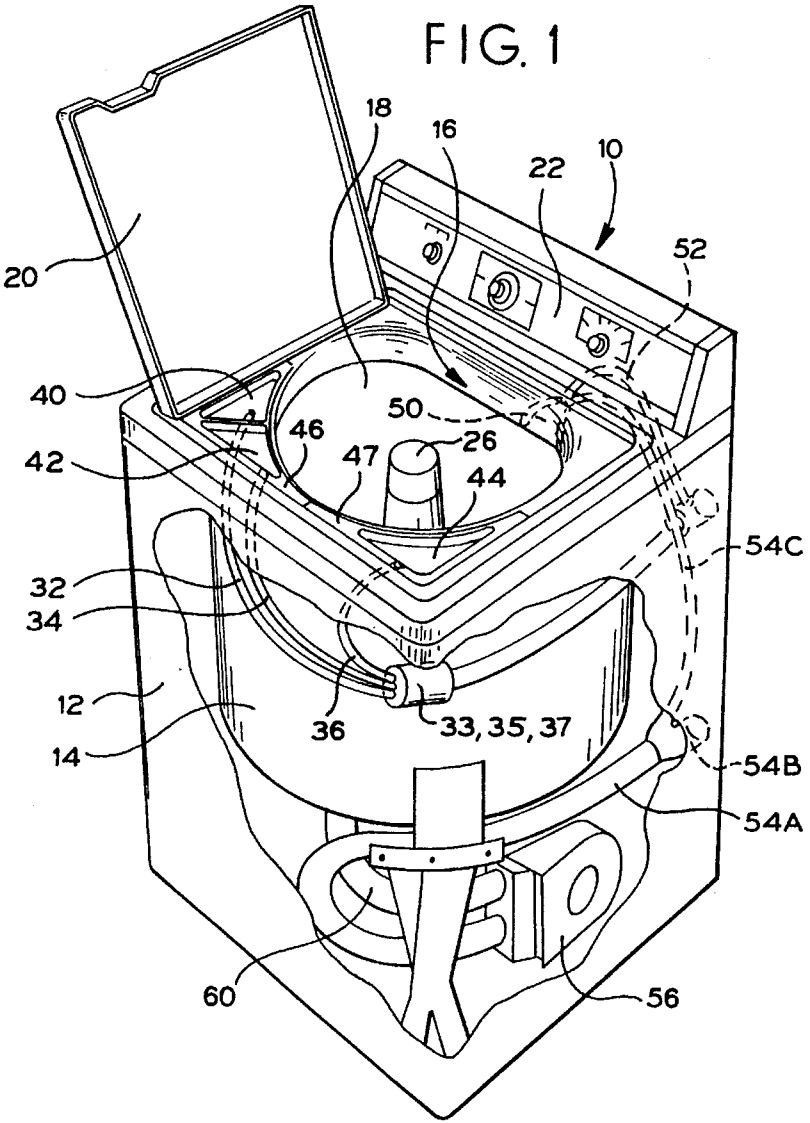
FIG. 1 illustrates a perspective view of a washer appliance embodying features of the present invention, having a portion cut away to illustrate detail of internal components.

FIG. 1 generally illustrates a washer 10 embodying features of the present invention. The washer 10 includes a housing 12, a wash tub 14, a tub ring 16 defining an opening 18, a hinged lid 20 for covering the opening 18, and controls 22.

Figure 2:
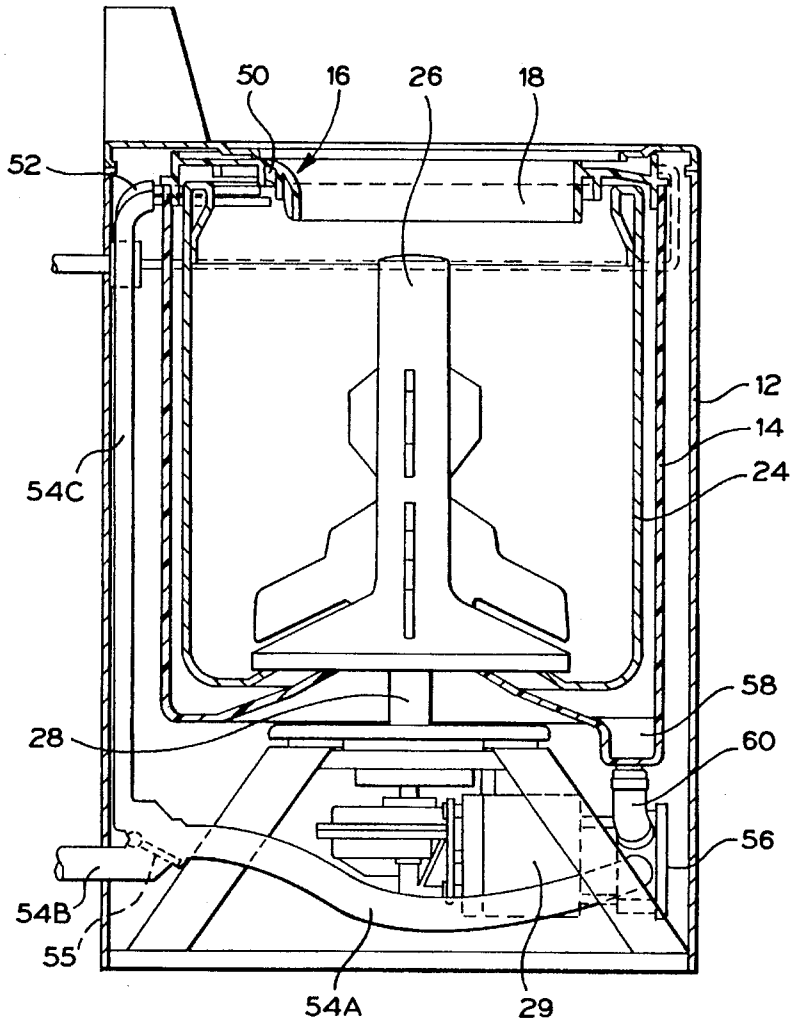
FIG. 2 illustrates a side, sectional view taken generally along line II—II of FIG. 1.

Turning to FIG. 2, the washer 10 further includes a wash basket 24 disposed within the wash tub 14, the wash basket 24 being rotatable on a vertical axis. The wash basket 24 has an upwardly facing open end accessible through the opening 18. The wash tub 14 generally has a solid, cylindrical wall to contain water. The wash basket 24 is similar in shape, however, is slightly smaller in diameter than the wash tub 14 so that the wash basket 24 fits rotatably within the wash tub 14. The wash basket 24 has perforations or holes (not shown) so that water can flow therethrough. The wash tub 14 is secured relative to the housing 12. A paddled agitator 26 extends vertically upward from the bottom of the wash tub 14 and resides within the wash basket 24. The wash basket 24 is rotatably moveable on a shaft 28 which is rotatably sealed relative to the fixed wash tub 14. The shaft 28 is driven by an electric motor 29.

In the embodiment illustrated, the tub ring 16 can include a plurality of wash additive dispensers 40, 42, and 44. As seen in FIGS. 1 and 2, these dispensers are accessible when the hinged lid 20 is in an open position. The dispensers 40 and 42 can be used for dispensing additives such as bleach or fabric softeners and the dispenser 44 can be used to dispense detergent into the washload at an appropriate time in the automatic wash cycle.

Figure 3:
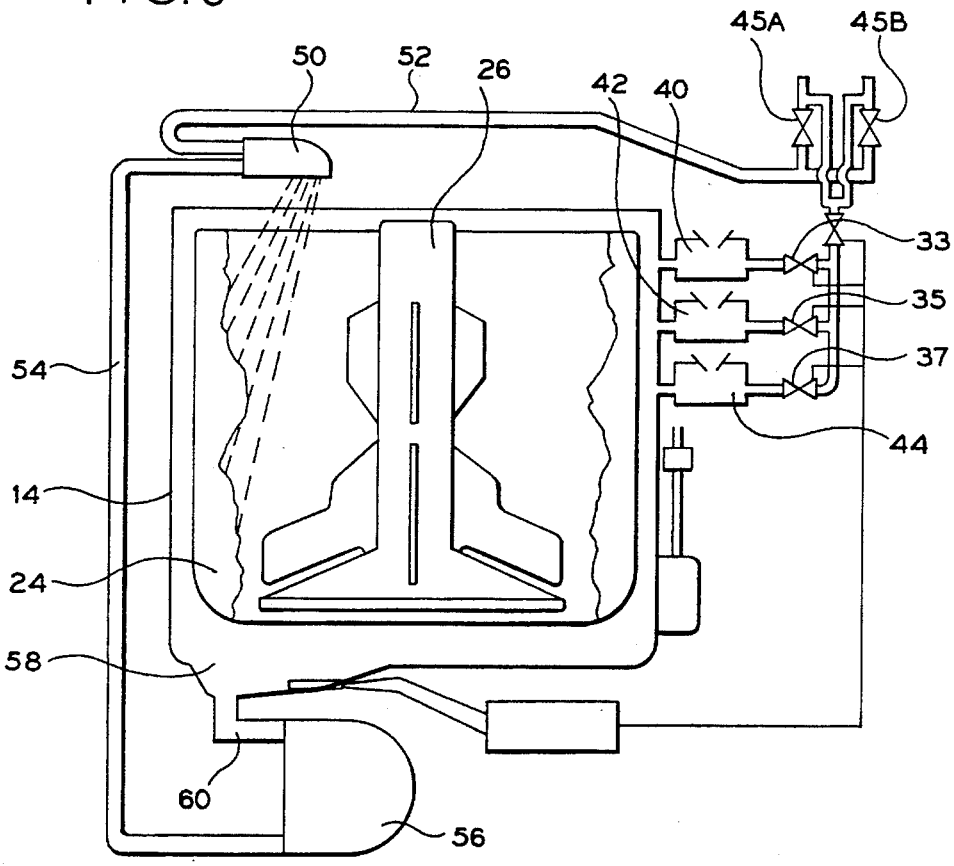
FIG. 3 illustrates schematic view of the washer.

Referring to FIG. 3, the washer 10 includes a water inlet having controllable hot and cold valves 45A and 45B. Furthermore, as illustrated in FIG. 1, the washer 10 includes a first fresh water conduit 30 which is divided into sub-conduits 32, 34, and 36. Sub-conduits 32 and 34 supply a flow of water to dispensers 40 and 42, respectively. Similarly, sub-conduit 36 supplies water to the dispenser 44. Water flow through the conduits 32, 34, and 36 can be controlled through a conventional means such as respective solenoid operated valves 33, 35, 37, shown schematically in FIG. 3, to flush the additives into the washload.

The dispensers 40 and 42 can be of a known type to receive and dispense liquid additives into the wash tub 14. The dispenser 44 can be of the type for dispensing a granular wash additive, such as the dispenser disclosed in U.S. Pat. No. 4,700,554. Preferably, the upper portions of the dispensers 40 and 42 seen in FIG. 1 are formed by an upper panel 46, and the upper portion of the dispenser 44 is similarly formed by a panel 47, both of which panels 46 and 47 insert and secure in a recess 48 (FIG. 4) in the tub ring 16.

Additionally, in the embodiment illustrated in FIGS. 1 and 2, the tub ring 16 can include a nozzle 50 for supplying fresh water or recirculated wash water to the wash tub 14. The nozzle 50 receives a second fresh water conduit 52 which supplies fresh water from the valves 45A and 45B to the nozzle 50.

As illustrated in FIG. 2, the wash tub 14 has a lower drain portion 58 which can drain water through a drain conduit 60 to a recirculation pump 56. During initial filling and final rinse cycles, fresh water is provided through the nozzle 50. At various other times during the wash cycle, wash water is recirculated from the tub 14 to the nozzle 50. As shown in FIGS. 1 and 2, wash water exits the recirculation pump 56 through a tube 54A. A valve 55 can selectively direct the flow to either a drain exit tube 54B or to a recirculation tube 54C. FIG. 3 schematically illustrates the washer 10, by which the above-described components operate in a generally known manner. In FIG. 3, a tube 54 generally represents the route of tubes 54A and 54C in FIG. 2.

Figure 4:
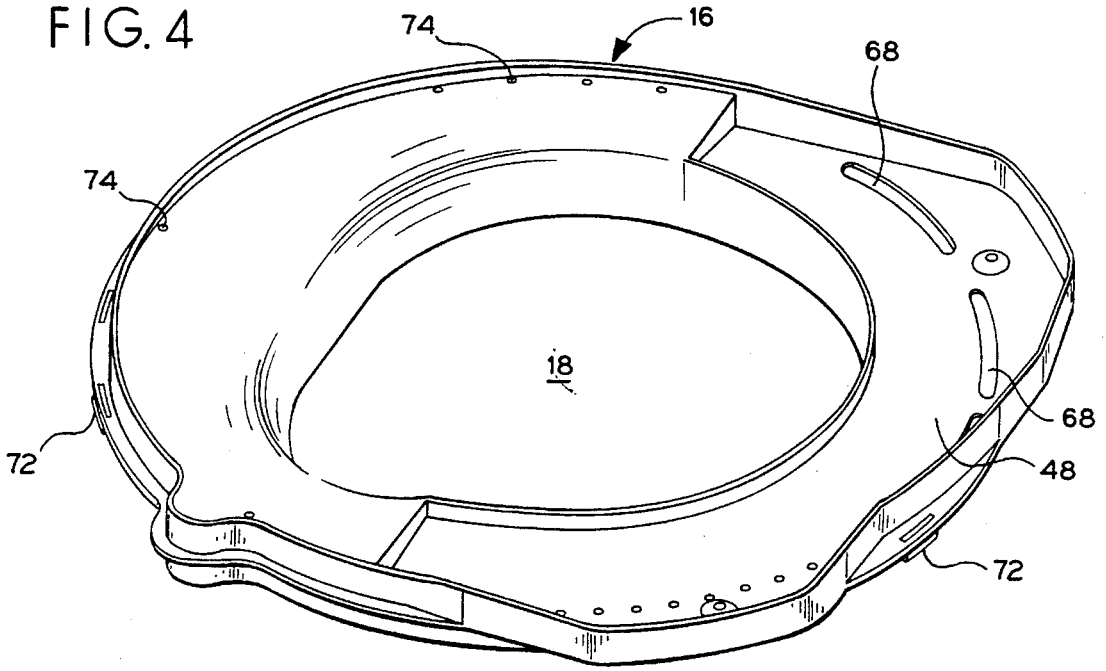
FIG. 4 illustrates a perspective view of the tub ring according to an embodiment of the present invention.
Figure 5:
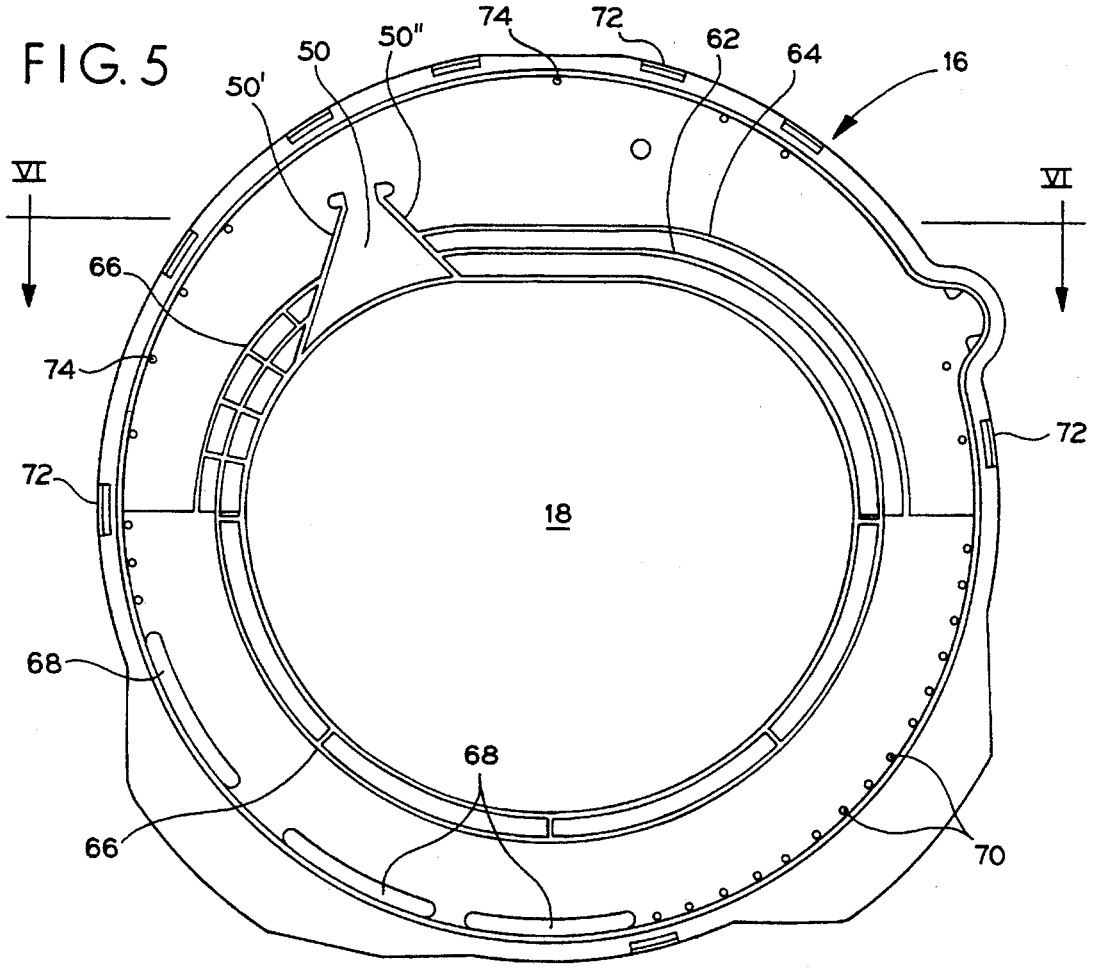
FIG. 5 illustrates a bottom plan view of the tub ring of FIG. 4.
Figure 6:
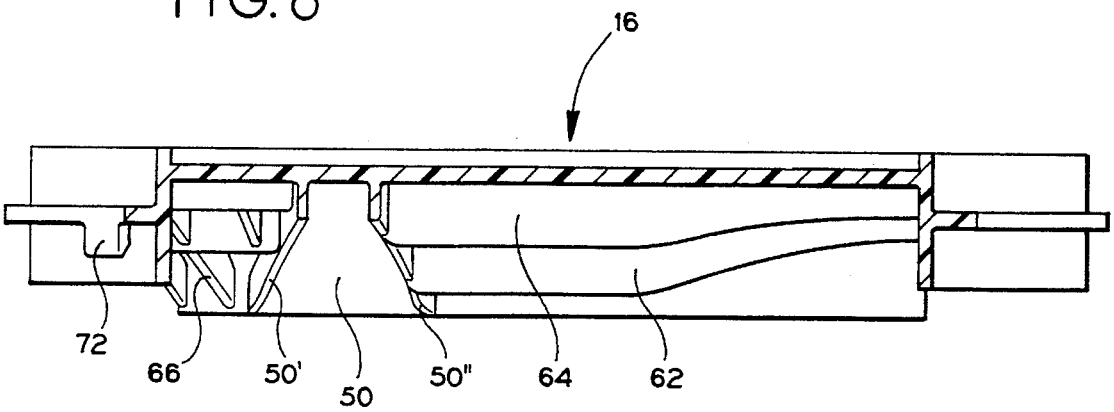
FIG. 6 illustrates a side sectional view taken generally along line VI—VI of FIG. 5.

FIGS. 4, 5 and 6 illustrate the tub ring 16. The tub ring 16 is generally annular, having an at least partially rounded interior area defining the opening 18 to the wash basket 24 through which clothes are placed in and removed from the washer 10. The tub ring 16 generally forms an upper surface of the washer 10 which is generally covered by the hinged lid 20. The opening 18 is dimensioned smaller than the diameter of the wash basket 24, so that a portion of the tub ring 16 overhangs the perimeter of the basket 24. This prevents items from accidently being dropped between the wash basket 24 and the wash tub 14.

As illustrated in FIGS. 5 and 6, the tub ring 16 includes a clothes diverter which, in the illustrated embodiment, comprises first and second curved or ramped diverter walls 62 and 64. The diverter walls 62 and 64 are located in the portion of the tub ring 16 which overhangs the wash basket 24, and extend downwardly toward the interior of the wash basket 24. As seen in FIG. 6, the diverter walls 62 and 64 slope downwardly, preferably toward the nozzle 50.

During washing, dry clothes which are piled high in the wash basket 24 contact the diverter walls 62, 64. At an initial part of the wash cycle, the clothes are moved in a rotational direction along the downward slope of the diverter walls 62 and 64. The diverter thereby pushes and guides the clothes downward into the flow of water from the nozzle 50. The downward movement of clothes results in quicker wetting, decreasing the overall wash time.

As shown in FIG. 5, the nozzle 50 is generally formed by a pair of opening V-shaped walls 50' and 50" in the lower side of the tub ring 16. Preferably, each of the diverter walls 62 and 64 slopes downward to a level slightly below the level of the nozzle wall 50" where the respective diverter walls and the nozzle wall 50" ultimately meet. The second fresh water conduit 52 and the recirculation conduit 54 are secured at a narrow end of the nozzle 50 (FIGS. 1 and 2), providing either fresh water or recirculated wash water, respectively. The water flowing from the conduits 52 or 54C is directed inwardly under the tub ring 16, being deflected downwardly and diffused along the curved contour of the opening 18 into the wash basket 24. Also shown in FIG. 5 are reinforcing walls 66 which add rigidity to the tub ring.

Referring back to FIG. 4, the upper side of the tub ring 16 can be formed to have the recess 48 for receiving the upper panels 46 and 47 (FIG. 1) which form portions of the dispensers 40, 42, and 44. As shown, the tub ring 16 has flow slots 68 for the dispenser 44, and flow holes 70 for the dispensers 40 and 42 for flushing additives into the washload.

As illustrated in FIGS. 4–6, the periphery of the tub ring 16 has a plurality of downwardly extending mounting clips 72 which engage cooperative slots (not shown) in the housing 12. Also, a plurality of mounting holes 74 are provided in the tub ring 16 through which respective connectors, such as screws (not shown) can extend to also engage the housing 12.

It should be understood that various changes and modifications to the presently preferred embodiments described herein will be apparent to those skilled in the art. For example, the diverter could be shaped differently so long as it guides clothes downwardly. Such changes and modifications may be made without departing from the spirit and scope of the present invention and without diminishing its attendant advantages. It is, therefore, intended that such changes and modifications be covered by the appended claims.

The embodiments of the invention in which an exclusive property or privilege is claimed are therefore defined as follows:

1. A diverter for a clothes washer, said washer having a housing and a wash basket rotatable about a vertical axis, said housing having an opening providing access to said wash basket, said diverter comprising:

at least one rigid projection secured to said housing extending downwardly toward said basket along a partial circumference of the opening, guiding clothes in said basket away from said opening when said basket rotates.

2. The diverter according to claim 1 further comprising:

a water supply nozzle connectable to a water supply to provide a flow of water into said wash basket;

wherein said diverter extends downwardly proximal to said nozzle so that clothes are deflected downwardly into said flow.

3. The diverter according to claim 1 wherein said diverter is curved in shape.

4. The diverter according to claim 1, wherein said diverter comprises at least one generally vertical wall extending at least partially around the opening, at least part of the wall being downwardly sloping.

5. The diverter according to claim 1 wherein said diverter is integral to a tub ring secured to said housing defining said opening.

6. The diverter according to claim 5 wherein said tub ring further comprises a water supply nozzle formed therein.

7. The diverter according to claim 5 wherein said tub ring further comprises at least one additive dispenser formed therein.

8. A tub ring for a clothes washer, wherein the tub ring defines an opening to a wash basket rotatable on a vertical axis, said tub ring having an inner diameter smaller than a diameter of said wash basket, forming an overhang over said wash basket, the tub ring comprising:

a diverter extending generally along a partial circumference of said overhang toward said wash basket, said diverter having a graduated vertical dimension to deflect clothes downwardly into said basket when said basket rotates.

9. The tub ring according to claim 8 further comprising:

at least one additive dispenser formed therein.

10. The tub ring according to claim 8 further comprising:

a spray nozzle which connects to a water supply to introduce a flow of water into said basket.

11. The tub ring according to claim 8 wherein said opening is at least partially rounded over.

12. A clothes washing appliance comprising:

a housing;

a rotatable wash basket;

an upper opening into said wash basket; and a diverter secured to the housing adjacent to said opening, the diverter sloping downwardly around a partial circumference of said opening to guide clothes downwardly into said basket when said basket rotates.

13. The clothes washing appliance according to claim 12, further comprising:

a water supply;

a nozzle adjacent to said opening providing a flow of water from said water supply into said basket;

wherein said diverter projects farthest into said wash basket generally adjacent to said nozzle so that clothes are deflected downwardly into said flow.

14. The clothes washing appliance according to claim 12, further comprising:

a tub ring secured to the housing around the opening, the diverter being integral to the tub ring.

15. The clothes washing appliance according to claim 14 wherein the tub ring further comprises:

an at least one additive dispenser.

16. The clothes washing appliance according to claim 14 wherein the nozzle is at least partially formed in the tub ring.

17. The clothes washing appliance according to claim 16 wherein the tub ring further comprises:

an upper recess; and at least one panel securable in said recess forming at least one additive dispenser.

18. The diverter according to claim 1, wherein said diverter comprises:

at least one generally vertical wall having a section which extends substantially around a circumference of said opening at a first vertical height, and a section extending partially around said circumference and having a vertical dimension lower than said first vertical height.

* * * * *